United States Patent [19]

Napolitano

[11] 4,148,105

[45] Apr. 10, 1979

[54] TOILET TANK SECURING DEVICE

[76] Inventor: John P. Napolitano, 464 Ridge Rd., Orange, Conn. 06477

[21] Appl. No.: 863,790

[22] Filed: Dec. 23, 1977

[51] Int. Cl.[2] ..... E03D 1/00

[52] U.S. Cl. ..... 4/353; 292/251; 292/301

[58] Field of Search ..... 4/353, 1, 251; 220/323, 220/324, 325, 328, 327, 326; 292/251, 301, 58

[56] References Cited

U.S. PATENT DOCUMENTS

| | | | |
|---|---|---|---|
| 293,776 | 2/1884 | Paulus | 220/323 |
| 977,491 | 12/1910 | Vigdal | 220/323 |
| 1,477,043 | 12/1923 | Drake | 220/323 |
| 1,728,945 | 9/1929 | Porter | 220/323 |
| 1,984,403 | 12/1934 | Edelman | 4/353 |
| 3,889,993 | 6/1975 | Bright | 292/251 |

*Primary Examiner*—Richard E. Aegerter
*Assistant Examiner*—L. Footland
*Attorney, Agent, or Firm*—Daniel Jay Tick

[57] ABSTRACT

A lock member projects perpendicularly from the inner surface of the top of a toilet tank cover into the tank and has a bore formed therethrough. A lock rod passes through the bore through the lock member and bores formed through the front walls of the toilet tank in alignment with the bore of the lock member. The lock rod has a threaded part coupled in the bore through the front wall of the tank and a head having keyholes formed therein for accommodating a special key whereby the lock rod is rotatable by the key to insert it through the bores of the tank and lock member and to remove the lock rod from the bores.

1 Claim, 2 Drawing Figures

TOILET TANK SECURING DEVICE

BACKGROUND OF THE INVENTION

The present invention relates to a toilet tank securing device. More particularly, the invention relates to a toilet tank securing device for locking a toilet tank cover to a toilet tank to secure the tank from tampering and theft of parts therein. The toilet tank has spaced parallel front and back walls and the toilet tank cover has a top with spaced parallel substantially flat inner and outer surfaces.

Toilet tank securing devices are disclosed in the following United States patents. U.S. Pat. No. 735,927, issued Aug. 11, 1903 to Woodruff, U.S. Pat. No. 1,688,977, issued Oct. 23, 1928 to Lundberg et al, U.S. Pat. No. 3,654,637, issued to Young on Apr. 11, 1972, U.S. Pat. No. 3,760,428, issued Sept. 25, 1973 to Korol, U.S. Pat. No. 3,905,050, issued Sept. 16, 1975 to Goza et al and U.S. Pat. No. 3,965,493, issued June 29, 1976 to Bemis.

Objects of the invention are to provide a toilet tank securing device of simple structure, which is inexpensive in manufacture, installed with facility and convenience on toilet tanks of all ages, and functions efficiently, effectively and reliably to prevent tampering with the parts in the toilet tank and to prevent theft of parts in the toilet tank.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
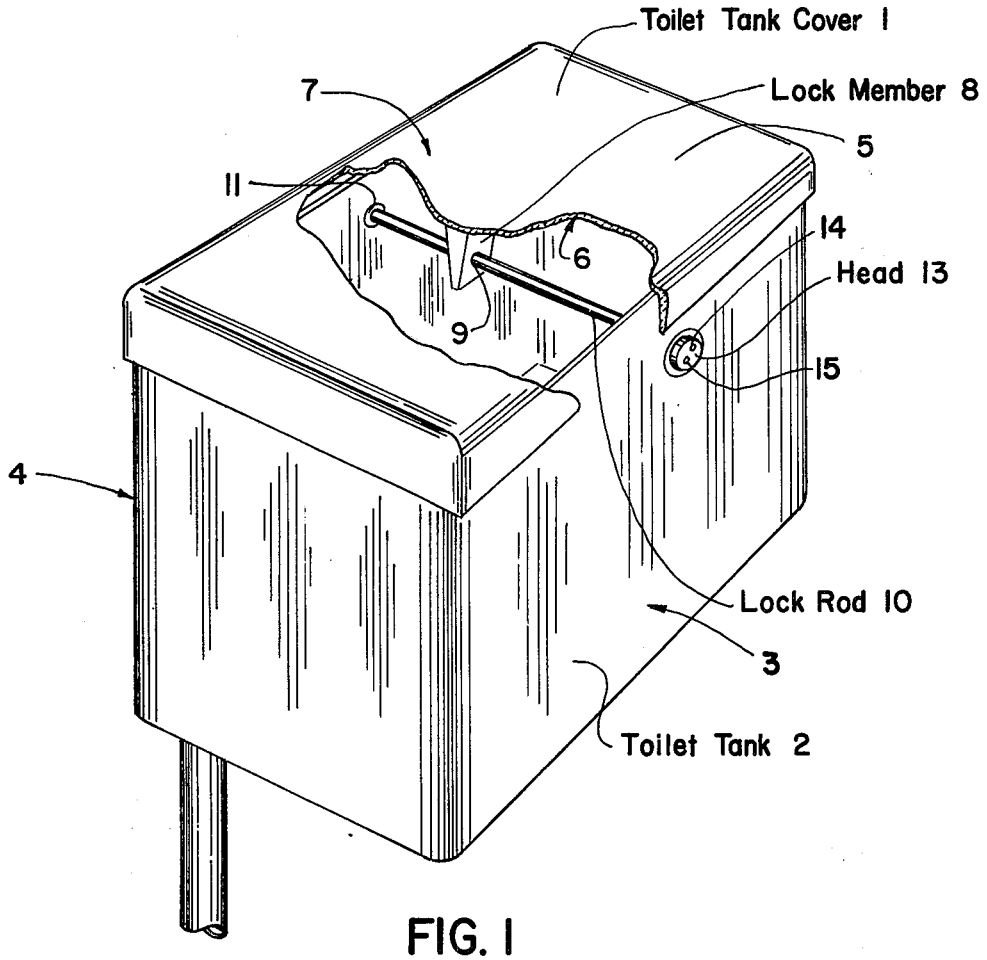
FIG. 1 is a perspective view, partly cutaway, of an embodiment of the toilet tank securing device of the invention, as installed in a toilet tank.

The toilet tank securing device of the invention locks a toilet tank cover 1 to a toilet tank 2, as shown in FIG. 1, to secure the tank from tampering and theft of parts therein. The toilet tank 2 has spaced parallel front and back walls 3 and 4, respectively (FIG. 1). The toilet tank cover 1 has a top 5 with spaced parallel substantially flat inner and outer surfaces 6 and 7, respectively, as shown in FIG. 1.

Figure 2:
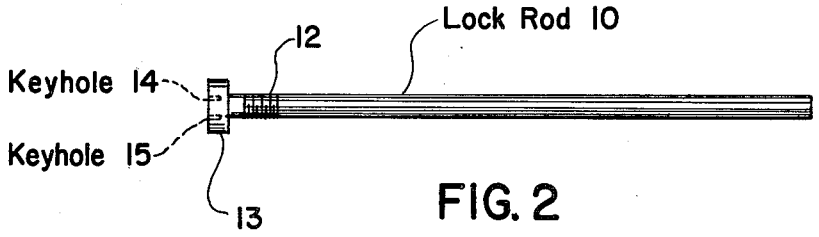
FIG. 2 is a view, on an enlarged scale, of an embodiment of the lock rod of the toilet tank securing device of the invention.

The toilet tank securing device of the invention comprises a lock member 8 projecting substantially perpendicularly from the inner surface 6 of the top 5 of the toilet tank cover 1 into the tank 2. The lock member 8 has a bore 9 formed therethrough, as shown in FIG. 1. A lock rod 10 (FIGS. 1 and 2) passes through the bore 9 through the lock member 8, a bore (not shown in the FIGS.) through the front wall 3 of the toilet tank 2, and a bore 11 through the back wall of said toilet tank in alignment with the bore through the lock member. The lock rod 10 has an externally threaded part 12, shown in FIG. 2, threadedly coupled in the bore through the front wall 3, which is internally threaded. The lock rod 10 also has a head 13 (FIGS. 1 and 2) having keyholes 14 and 15 formed therein for accommodating a special key, not shown in the FIGS.

The lock rod 10 is thus rotatable by the special key to insert said lock rod through the bores of the tank and the lock member 8 and to remove said lock rod from said bores. When the lock rod 10 extends through the bores of the tank and of the lock member 8, the tank cover 1 is secured to the tank 2. As long as the lock rod 10 remains in position, the tank cover 1 cannot be removed from the tank 2 and the component parts of said tank are safe from tampering and theft. When it is desired by a responsible person to remove the cover 1 for repair or inspection, this is readily accomplished by utilization of the special key to remove the lock rod 10.

While the invention has been described by means of a specific example and in a specific embodiment, I do not wish to be limited thereto, for obvious modifications will occur to those skilled in the art without departing from the spirit and scope of the invention.

I claim:

1. A toilet tank securing device for locking a toilet tank cover to a toilet tank to secure the tank from tampering and theft of parts therein, said toilet tank having spaced parallel front and back walls and said toilet tank cover having a top with spaced parallel substantially flat inner and outer surfaces, said toilet tank securing device comprising a lock member projecting substantially perpendicularly from the inner surface of the top of the toilet tank cover into the tank, said lock member having a bore formed therethrough; and a lock rod passing through the bore through the lock member and bores formed through the front and back walls of the toilet tank in alignment with the bore through the lock member, said lock rod having an externally threaded part threadedly coupled in the bore through the front wall and a head having keyholes formed therein for accommodating a special key whereby said lock rod is rotatable by said key to insert the said lock rod through the bores of the tank and the lock member and to remove the said lock rod from said bores.

* * * * *